US005963506A

United States Patent [19]

McEachern et al.

[11] Patent Number: 5,963,506

[45] Date of Patent: Oct. 5, 1999

[54] LOW FLOW NOISE SONOBUOY SUSPENSION SYSTEM

[75] Inventors: James F. McEachern, Leonardtown, Md.; Joseph M. McCandless, Newtown, Pa.

[73] Assignee: The United States of America as represented by the Secretary of the Navy, Washington, D.C.

[21] Appl. No.: 09/122,205

[22] Filed: Jul. 6, 1998

[51] Int. Cl.[6] ..... H04B 1/59

[52] U.S. Cl. ..... 367/4; 367/3

[58] Field of Search ..... 367/3, 4; 441/21, 441/33

[56] References Cited

U.S. PATENT DOCUMENTS 3,543,228 11/1970 Farmer et al. .
3,711,821 1/1973 Dale et al. .
3,922,989 12/1975 McEachern .
3,992,737 11/1976 Duel et al. .
5,020,032 5/1991 Dale et al. .
5,056,065 10/1991 Bruengger ..... 367/4
5,197,036 3/1993 Buckingham ..... 367/4

*Primary Examiner*—Ian J. Lobo
*Attorney, Agent, or Firm*—James McEwen

[57] ABSTRACT

A low flow noise sonobuoy suspension system having a surface float, a suspension cable having a compliant portion, a bridle, a hydrophone, a mechanical cable, a terminal weight, and a drogue. The hydrophone is located within the bridle and is attached to the bridle so as to allow the hydrophone to remain roughly vertical if the bridle is tilted. The bridle is located below the surface float and is connected to the surface float by means of the suspension cable. The drogue is located below the bridle and is connected to the bridle by a mechanical cable. The drogue is connected at an attachment point on the mechanical cable such that the relative velocity of the hydrophone is negligible. The terminal weight is also attached to the mechanical cable. By means of this arrangement, both the horizontal motion noise caused by the relative velocity of the hydrophone, and the vertical motion noise caused by the surface waves are reduced.

20 Claims, 2 Drawing Sheets

LOW FLOW NOISE SONOBUOY SUSPENSION SYSTEM

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates to a sonobuoy which will reduce the noise caused by placing the sonobuoy in a high shear current environment. Specifically, the sonobuoy reduces the noise by placing the hydrophone at a depth where the velocity of the current at the hydrophone is the same as the drift velocity of the sonobuoy system.

2. Description of the Related Art

In general, sonobuoys consist of four elements: a surface float, a hydrophone, a terminal weight, and a drogue. All of these parts, save the hydrophone, are used to position the hydrophone at a desired listening depth. In order to be effective, the hydrophone should remain as still as possible while at this depth. Any movement of the hydrophone could result in unwanted noise which decreases the effectiveness of the hydrophone. There are two basic motions which cause this unwanted noise: a vertical motion noise associated with vertical motion, and a horizontal motion noise associated with horizontal motion. The vertical motion is caused by surface waves interacting with the surface float, whereas the horizontal motion is caused by the varying current velocities at different water depths.

As discussed in U.S. Pat. No. 3,711,821 to Dale, some prior sonobuoys reduced the vertical motion by- attaching an elastic portion, called the compliant portion, to the cable between the hydrophone and the surface float, and attaching a terminal weight below that compliant portion. This compliant portion acted to dampen the effects of the vertical motion caused by the surface waves. Other systems utilized dampening systems such as that described in U.S. Pat. No. 5,020,032 to Dale U.S. Pat. No. 3,543,228 to Farmer. These systems reduced the vertical motion, and the associated vertical motion noise. However, the prior art failed to adequately reduce the noise caused by the horizontal motion.

The horizontal motion noise is caused by the variations in the current profile. As a whole, the sonobuoy drifts in the current at a constant drift velocity. However, depending on the depth, different parts of the sonobuoy are exposed to a variety of current velocities. This situation results in a difference between the drift velocity of the sonobuoy and the current velocity at the depth of each part. This difference in velocity is called the relative velocity for that part. Thus, the hydrophone has a relative velocity which is the difference between the current velocity at the depth of the hydrophone and the drift velocity of the sonobuoy. It is the relative velocity of the hydrophone which causes the horizontal motion noise which interferes with the effective operation of the sonobuoy system.

Prior solutions to reduce horizontal motion noise, such as those proposed in U.S. Pat. No. 3,711,821 to Dale, U.S. Pat. No. 3,992,737 to Duel, and U.S. Pat. No. 3,922,989 to McEachem, involved attaching a large drag area, called a drogue, above and near the hydrophone. By properly sizing the drogue, the relative velocity of the drogue is reduced.

Since the hydrophone is near the drogue, the relative velocity of the hydrophone is also reduced, which then reduces the horizontal motion noise. The larger the drogue area, the more it reduced the relative velocity of the drogue, and the more it reduced horizontal motion noise. However, where the relative velocity is high, such as in a high current shear environment, the drogue area would have to be so large as to be impracticable. Therefore, prior art designs could only be operated at a reduced effectiveness in these high current shear environments.

SUMMARY OF THE INVENTION

Accordingly, it is the object of this invention to improve the performance of a sonobuoy by reducing the horizontal motion noise caused by the relative velocity of the hydrophone.

It is a further object of the invention to improve the performance of a sonobuoy by reducing the vertical motion noise caused by the interaction of the surface float and the surface waves.

These and other objects are accomplished using a surface float, a suspension cable having a compliant portion, a hydrophone, a bridle, a mechanical cable, a terminal weight, and a drogue. The hydrophone is located within the bridle and is attached to the bridle so as to allow the hydrophone to remain roughly vertical if the bridle is tilted. The bridle is located below the surface float and is connected to the surface float by means of the suspension cable. The drogue is located below the bridle at such a depth that the relative velocity of the hydrophone is negligible. The mechanical cable connects the bridle to both the drogue and the terminal weight.

By means of this arrangement, the horizontal motion noise is reduced due to the placement of the drogue below the hydrophone. In addition, the vertical motion noise is greatly reduced through the damping effects of the compliant portion of the suspension cable and the terminal weight.

DESCRIPTION OF THE PREFERRED EMBODIMENT

Figure 1:
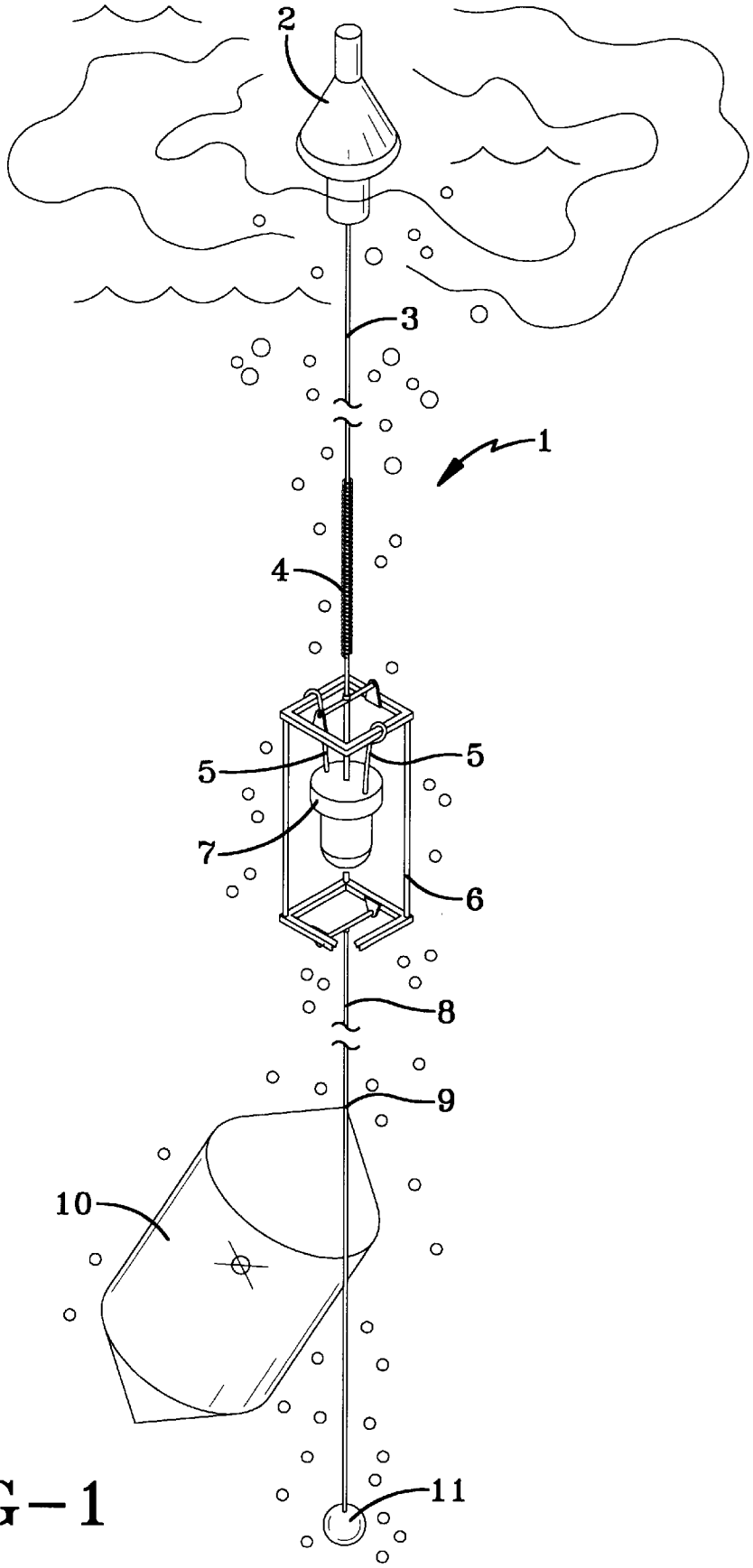
FIG. 1 is a side view of the preferred embodiment of the low flow noise sonobuoy suspension system showing the relative placement of the surface float, hydrophone, drogue, and the terminal weight.

Referring to FIG. 1, the preferred embodiment of the low flow noise sonobuoy suspension system (1) includes a surface float (2), a hydrophone (7) below the surface float (2), a terminal weight (11) and a located below the hydrophone (7).

The hydrophone (7) is housed in a bridle (6). Bridle cables (5) connect the hydrophone (7) to the bridle (6) in such a way as to allow the hydrophone (7) to remain roughly vertical if the bridle (6) is tilted.

The bridle (6) is connected to a suspension cable (3) which connects the bridle (6) with (2). In order to provide damping to the vertical motion caused by the surface waves, the suspension cable (3) has a compliant portion (4).

A mechanical cable (8) connects the bridle (6) to both the drogue (1) and the terminal weight (11). The drogue (10) is attached to the mechanical cable (8) at a predetermined attachment point (9). The mechanical cable (8) can be fabricated from a material such as monofilament nylon.

Figure 2:
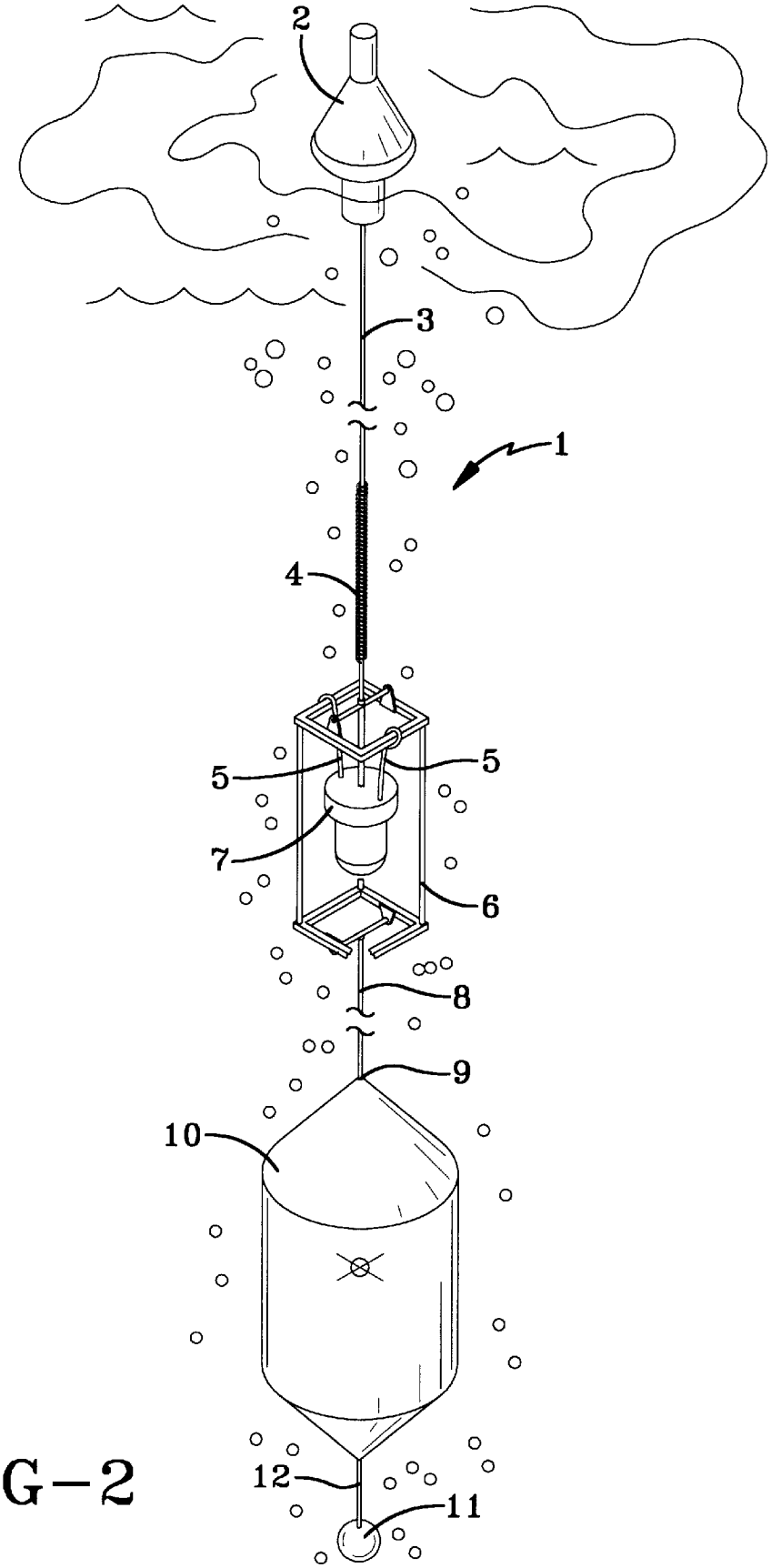
FIG. 2 is a side view of an alternative embodiment of the low flow noise sonobuoy suspension system showing the relative placement of the surface float, hydrophone, drogue, and the terminal weight.

Alternatively, as shown in FIG. 2, the terminal weight (11) can be attached to the drogue (10) using a terminal cable (12).

The drogue (10) must be below the bridle (6) at a depth such that the hydrophone (7) is located in the current profile where the relative velocity of the hydrophone (7) is nearly zero. By adjusting the length of the mechanical cable (8), the hydrophone (7) may be placed at a depth where the relative velocity of the hydrophone is nearly zero. It is at this depth, where the relative velocity is nearly zero, that the noise created by the relative velocity will be minimized.

Assuming that the low flow sonobuoy suspension system (1) is in steady state, the relative velocity profile is linear, and that the only non-negligible drag is that caused by the drogue (10) and the surface float (2), the location of the attachment point (9) below the bridle (6) along the length of the mechanical cable (8) can be approximated by the following equation:

$$S_{mc} = \frac{S_{sc}}{\sqrt{\frac{(C_d A)_{dr}}{(C_d A)_{sf}}}}$$

Where:

$S_{sc}$=Length of the suspension cable (3)

$S_{mc}$=Distance between the attachment point (9) and the hydrophone (7)

$C_{ddr}$=Coefficient of drag for the drogue (10)

$A_{dr}$=Projected area of the drogue (10)

$C_{dsf}$=Coefficient of drag for the surface float (2)

$A_{sf}$=Projected area of the surface float (2)

For example, assuming that $A_{sf}$ is 2 $ft^2$, $C_{dsf}$ is 0.9, and the total drag of the drogue (10) ($A_{dr}$*$C_{ddr}$) is 15 $ft^2$, then the location of the attachment point (9) along the length of the mechanical cable (8) would be governed by the following equation: $S_{mc}$=$S_{sc}$*0.3464101615138. If the hydrophone (7) is to be held at a depth of 90 ft, then the length of suspension cable (3) would have to also be 90 ft. Therefore, the attachment point (9) along the length of the mechanical cable (8) would be 31.2 ft below the hydrophone (7).

What is described is only one of many possible variations on the same invention and is not intended in a limiting sense. The claimed invention can be practiced using other variations not specifically described above.

What is claimed is:

1. A low flow noise sonobuoy suspension system comprising:

a surface float;

a hydrophone located below said surface float;

a suspension cable connecting said surface float and said hydrophone;

a drogue below said hydrophone; and a mechanical cable connecting said drogue and said hydrophone.

2. The low flow noise sonobuoy suspension system as described in claim 1 where said drogue is connected to said mechanical cable at an attachment point, where said attachment point is located a distance, Smc, from said hydrophone, where said distance, Smc, is governed by the following equation:

$$S_{mc} = \frac{S_{sc}}{\sqrt{\frac{(C_d A)_{dr}}{(C_d A)_{sf}}}},$$

and where $S_{sc}$ is the length of said suspension cable, $C_{ddr}$ is the Coefficient of drag for said drogue, $A_{dr}$ is the projected area of said drogue, $C_{dsf}$ is Coefficient of drag for said surface float, and $A_{sf}$ is the Projected area of said surface float.

3. The low flow noise sonobuoy suspension system as described in claim 1 further including a terminal weight connected to said mechanical cable.

4. The low flow noise sonobuoy suspension system as described in claim 3 where said suspension cable further includes a compliant portion.

5. The low flow noise sonobuoy suspension system as described in claim 4 where said mechanical cable is fabricated from nylon.

6. The low flow noise sonobuoy suspension system as described in claim 2 further including a terminal weight connected to said mechanical cable.

7. The low flow noise sonobuoy suspension system as described in claim 6 where said suspension cable further includes a compliant portion.

8. The low flow noise sonobuoy suspension system as described in claim 7 where said mechanical cable is fabricated from nylon.

9. A low flow noise sonobuoy suspension system comprising:

a surface float;

a bridle below said surface float;

a suspension cable connecting said surface float to said bridle;

a hydrophone within said bridle;

at least one bridle cable connecting said hydrophone to said bridle so as to allow said hydrophone to retain a roughly vertical orientation;

a drogue below said bridle; and a mechanical cable connecting said bridle to said drogue.

10. The low flow noise sonobuoy suspension system as described in claim 9 where said drogue is connected to said mechanical cable at an attachment point, where said attachment point is located a distance, Smc, from said hydrophone, where said distance, Smc, is governed by the following equation:

$$S_{mc} = \frac{S_{sc}}{\sqrt{\frac{(C_d A)_{dr}}{(C_d A)_{sf}}}},$$

and where $S_{sc}$ is the length of said suspension cable, $C_{ddr}$ is the Coefficient of drag for said drogue, $A_{dr}$ is the projected area of said drogue, $C_{dsf}$ is Coefficient of drag for said surface float, and $A_{sf}$ is the Projected area of said surface float.

11. The low flow noise sonobuoy suspension system as described in claim 9 further including a terminal weight connected to said mechanical cable.

12. The low flow noise sonobuoy suspension system as described in claim 11 where said suspension cable further includes a compliant portion.

13. The low flow noise sonobuoy suspension system as described in claim 12 where said mechanical cable is fabricated from nylon.

14. The low flow noise sonobuoy suspension system as described in claim 10 further includes a terminal weight connected to said mechanical cable.

15. The low flow noise sonobuoy suspension system as described in claim 14 where said suspension cable further includes a compliant portion.

16. The low flow noise sonobuoy suspension system as described in claim 15 where said mechanical cable is fabricated from nylon.

17. A low flow noise sonobuoy suspension system comprising:

a surface float;

a bridle below said surface float;

a suspension cable connecting said surface float to said bridle;

a hydrophone within said bridle;

at least one bridle cable connecting said hydrophone to said bridle so as to allow said hydrophone to retain a roughly vertical orientation;

a drogue below said bridle;

a mechanical cable connecting said bridle to said drogue;

a terminal weight; and a terminal cable connecting said terminal weight to said mechanical cable.

18. The low flow noise sonobuoy suspension system as described in claim 17 where said drogue is connected to said mechanical cable at an attachment point, where said attachment point is located a distance, Smc, from said hydrophone, where said distance, Smc, is governed by the following equation:

$$S_{mc} = \frac{S_{sc}}{\sqrt{\frac{(C_d A)_{dr}}{(C_d A)_{sf}}}},$$

and where $S_{sc}$ is the length of said suspension cable, $C_{ddr}$ is the Coefficient of drag for said drogue, $A_{dr}$ is the projected area of said drogue, $C_{dsf}$ is Coefficient of drag for said surface float, and $A_{sf}$ is the Projected area of said surface float.

19. The low flow noise sonobuoy suspension system as described in claim 18 where said suspension cable further includes a compliant portion.

20. The low flow noise sonobuoy suspension system as described in claim 19 where said mechanical cable is fabricated from nylon.

* * * * *